US005086709A

United States Patent [19]

Fischer et al.

[11] Patent Number: 5,086,709

[45] Date of Patent: Feb. 11, 1992

[54] SLIDING GATE STRUCTURE WITH DUAL LINKAGE PER SINGLE ACTUATOR ARRANGEMENT

[75] Inventors: Robert T. Fischer, Homewood; Guadalupe L. Galvan, DeKalb, both of Ill.

[73] Assignee: Miner Enterprises, Inc., Geneva, Ill.

[21] Appl. No.: 469,990

[22] Filed: Jan. 25, 1990

[51] Int. Cl.[5] ..... B61D 7/20

[52] U.S. Cl. ..... 105/282.1; 105/286; 105/306

[58] Field of Search ..... 105/240, 250, 252, 253, 105/282.1, 286, 287, 304, 306, 311.1

[56] References Cited

U.S. PATENT DOCUMENTS

| | | | |
|---|---|---|---|
| 3,100,457 | 8/1963 | Dorey | 105/282.1 |
| 3,838,649 | 10/1974 | Barnard | 105/282.1 |
| 4,004,700 | 1/1977 | Empey | 105/240 |
| 4,120,409 | 10/1978 | Vander Werff | 105/240 |
| 4,338,058 | 7/1982 | Davenport | 105/240 |
| 4,454,822 | 6/1984 | Fischer | 105/282.1 |
| 4,583,901 | 4/1986 | Tyrer | 105/253 |

*Primary Examiner*—Robert J. Oberleitner
*Assistant Examiner*—S. Joseph Morano

[57] ABSTRACT

A sliding gate structure for controlling discharge of material from openings defined at a lower end of a railroad hopper car. The openings are covered by a pair of gates which linearly move in guide tracks to discharge the material inside or outside of the rails depending on which gate is operated. Each gate is independently operated by an operative mechanism including a control system operable from a side of the hopper car. Each operative mechanisms include a pair of linkage assemblies which are operated by a linearly distendable driver. The linkage assemblies are connected to opposite sides of the respective gate to inhibit skewing of the gate relative to the guide tracks during gate movement. Movement of each gate is independently controlled through actuation of the control system from the side of the hopper car.

1 Claim, 4 Drawing Sheets

SLIDING GATE STRUCTURE WITH DUAL LINKAGE PER SINGLE ACTUATOR ARRANGEMENT

FIELD OF THE INVENTION

The present invention generally relates to hopper cars and, more particularly, to a sliding gate structure for controlling discharge of material from a hopper car.

BACKGROUND OF THE INVENTION

Material or ballast is regularly added to railroad track road beds. To effect such ends, a railroad hopper car is filled with suitable material. The hopper car is rolled along the railroad tracks and the material is discharged through openings provided on the hopper car and directly into position on the tracks. It is known to control the size of the openings with sliding gates which are operable within guide tracks and which cover the openings. The position of the gate relative to the opening is typically controlled by a lever operated by a man walking alongside of the hopper car.

As will be appreciated by those skilled in the art, the weight of the material in the hopper car presses against the gate which covers the opening. The considerable weight of the material pressing against the gate makes it difficult to initially open the gate from a closed position. Moreover, the considerable weight acting against the gate makes it difficult to accurately control the size of the opening through which the material is discharged onto the road bed.

During its forced movement from a closed position, the gate often skews in the guide tracks causing the gate to jam. Such jamming problems delay the railroad bed repair work and often results in an inaccurate deposit of material onto the road bed. Inaccurate depositing of materials onto the road bed further requires more labor involvement in correcting such improper deposits.

SUMMARY OF THE INVENTION

In view of the above, and in accordance with the present invention, there is provided a sliding gate structure for controlling discharge of material from a railroad hopper car. The hopper car includes a walled housing with a series of openings through which material is discharged from the car. The openings are provided between sidewalls of the car at a lower end of a slanted chute defined by the housing. Each opening is covered by sliding gates which regulate the discharge of material from the opening. Each gate is independently moved generally parallel to the sidewalls between closed and open positions by an operative mechanism including a control system which is operated from the side of the car. The operative mechanism is designed to inhibit skewing of the gate and provides a mechanical advantage which facilitates opening and closing of the gate.

Each slide gate is arranged for generally linear movement along a predetermined path of travel within guide tracks forming part of the sliding gate structure. Each gate defines a generally planar surface which is moved endwise relative to the opening in the housing. The planar surface of the gate is inclined or canted relative to the predetermined linear path of movement to reduce the force required to open the gate. Moreover, a self-cleaning action is provided to the guide tracks as the gate moves along its predetermined path of travel.

Each sliding gate is independently moved between closed and open positions by an operative mechanism. Each operative mechanism includes a pair of linkage assemblies. Each linkage assembly is connected at one end to opposite sides of the sliding gate and at an opposite end to the housing. Connecting the linkage assemblies to opposite sides of the sliding gates inhibits the gate from skewing relative to the guide tracks during its movement. One linkage assembly of each operative mechanism is operatively associated with a linearly distendable driver which slidably moves the gate between closed and open positions or any position therebetween. Each driver is independently controlled from the side of the car by the control system.

In a preferred form of the invention, each linkage assembly of the operative mechanism is designed as a toggle mechanism which provides a mechanical advantage facilitating opening and closing of the gate. Each toggle mechanism includes first and second levers. The first lever includes a first end which is connected to one side of the gate and a second end. The second lever includes a first end pivotally connected to the housing and a second end which is connected at a pivotal joint to the second end of the first lever.

Preferably, the driver for moving the gate between closed and open positions includes a fluid operated, linearly distendable driver. In the illustrated embodiment, the driver is an air cylinder having one end connected to the housing and the opposite connected to one lever of a linkage assembly. Using an air cylinder provides several benefits. The air cylinder provides sufficient strength to overcome the substantial weight of the material pressing against the gate. Normally, gate size is determined by the amount of manual effort required to open the gate when the hopper car is filled with material. Use of an air cylinder to open and close the gate advantageously permits larger gate sizes to be used. Preferably, the driver provides a pushing force which is directed substantially perpendicular to the lever of the linkage assembly to which it is connected. When the gate is in a closed position, the cylinder is retracted so as to protect the operative end of the cylinder against damage during transportation of the hopper car.

Operation of each driver is independently regulated through actuation of the control system. In the preferred embodiment, the control system includes a series of valves which control fluid flow to each of the linearly distendable drivers. Each valve is advantageously mounted proximate to the side of the car to permit selective and substantially effortless actuation of the gates at an area remote from the opening and as the car moves along the track.

A salient feature of the present invention concerns the operative mechanism for moving the sliding gate between closed and open positions. Besides providing a slanted planar surface on the slidable gate, the linkage assemblies connected to opposite sides of each gate inhibit skewing of the gate relative to the guide tracks which determine its predetermined path of movement. Moreover, the linkage assemblies are designed to provide a mechanical advantage at initiation of the opening movement of the gate to yield a high break away force sufficient to separate the sliding gate from the weight of the material acting thereon.

The control system allows independent operation of the gates from the side of the car and promotes easier operation than heretofore known. By designing each operative mechanism with a dual linkage assembly, an equal force is applied to each side of the gate to facilitate opening and closing thereof. When comparing the linear movement of each gate between open and closed positions against the stroke length of the cylinder, approximately a 2:1 ratio is advantageously realized with the design of each linkage assembly.

Numerous other features and advantages of the present invention will become apparent from the following detailed description, the accompanying drawings, and the appended claims.

DETAILED DESCRIPTION OF A PREFERRED EMBODIMENT

Figure 1:
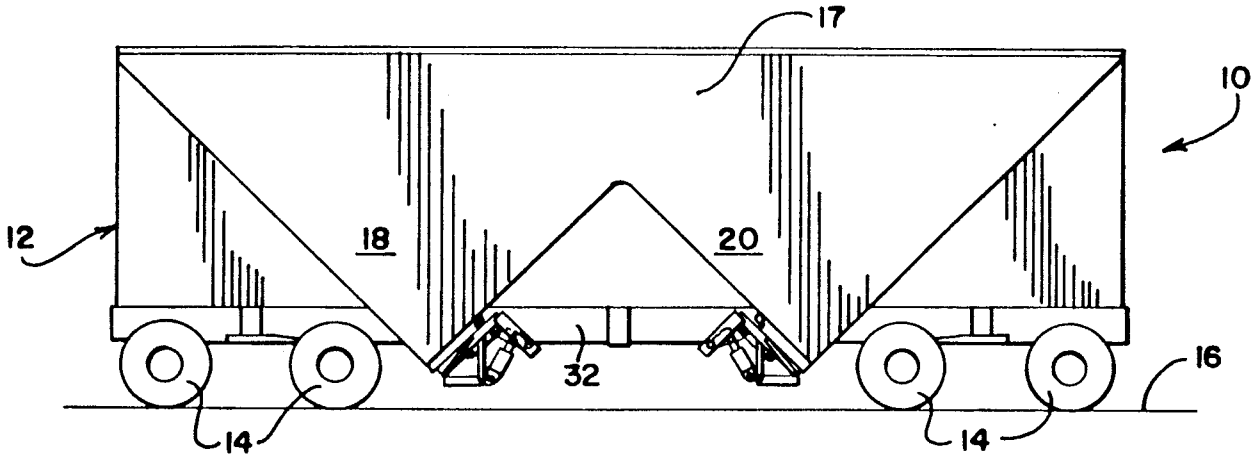
FIG. 1 is a schematic front elevational view of a hopper car embodying a sliding gate structure according to the present invention.

While the present invention is susceptible of embodiment in various forms, there is shown in the drawings a presently preferred embodiment hereinafter described, with the understanding that the present disclosure is to be considered as an exemplification of the invention, and is not intended to limit the invention to the specific embodiment illustrated.

Referring now to the drawings, wherein like reference numerals indicate like parts throughout the several views, there is shown a hopper car 10. As illustrated in FIG. 1, the hopper car 10 includes a housing 12 supported on wheels 14 for rolling movement over railroad tracks 16. The housing 12 of the hopper car comes in many different configurations but usually defines sidewalls 17 and 19 (FIG. 2) with at least one slanted chute portion depending from the underside of the car. Any number of chutes may be formed in different cars of the prior art, but for purposes of this description, two slanted chute portions 18 and 20 are illustrated between the sidewalls of the hopper car 10.

Figure 2:
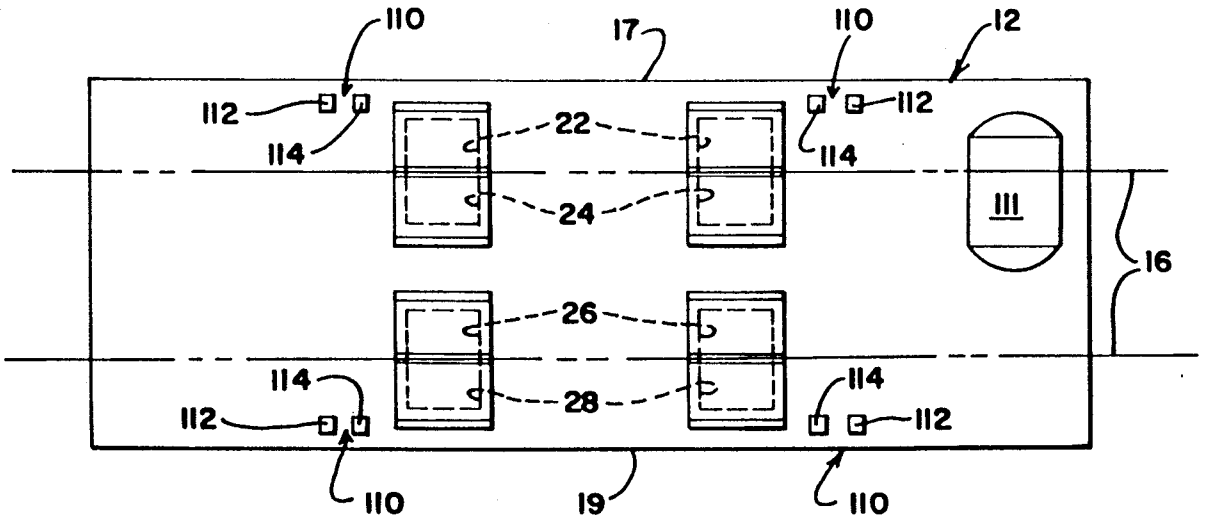
FIG. 2 is a schematic bottom plan view of the hopper car illustrated in FIG. 1.

As illustrated in FIG. 2, housing 12 of the hopper car 10 defines a series of openings 22, 24, 26 and 28 provided toward a lower end of the chute portions 18 and 20 for discharging material from the hopper car. Notably, openings 22, 26 are arranged to discharge material from one side of the hopper car while openings 24, 28 are arranged to discharge material from the opposite side of the hopper car.

Figure 3:
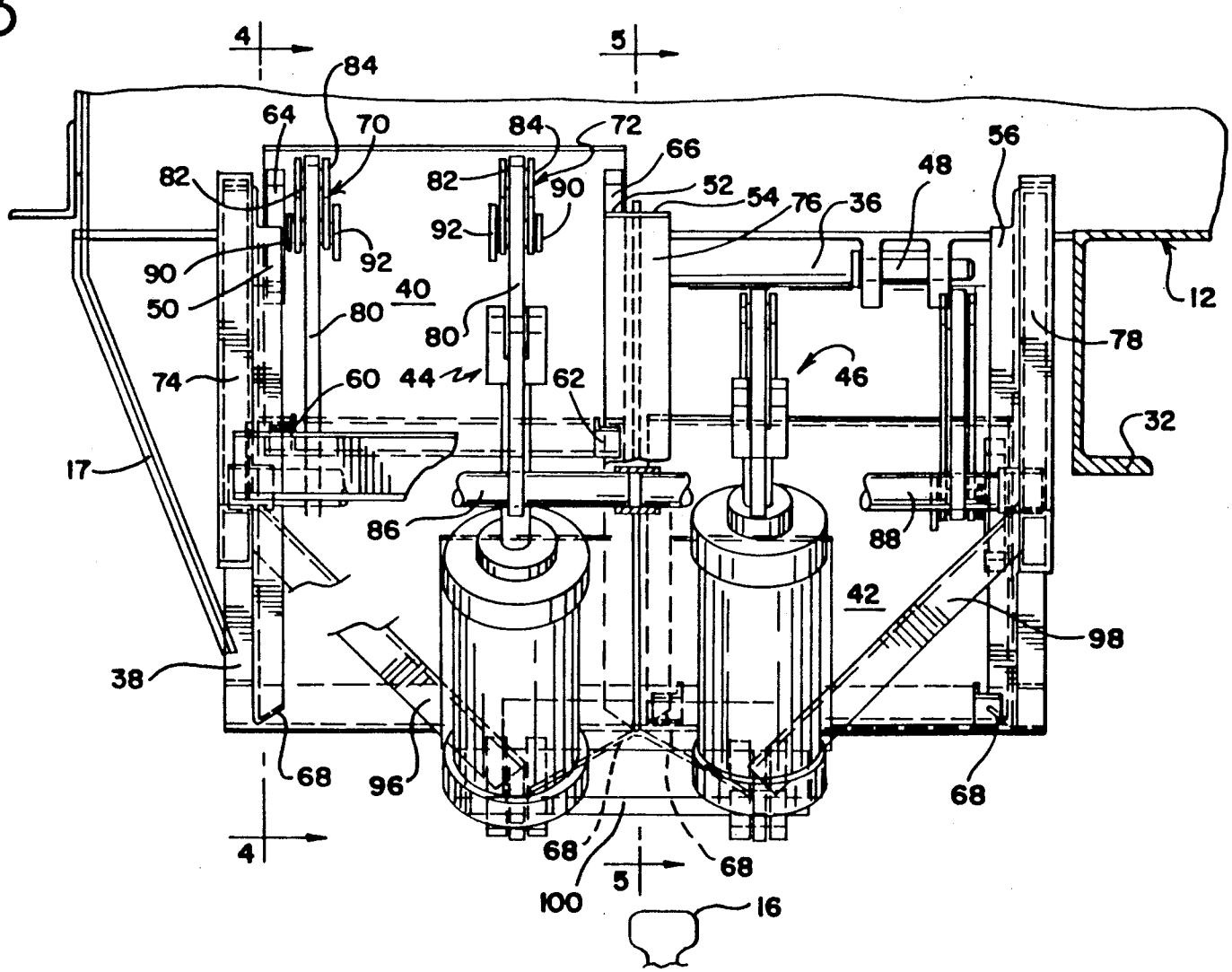
FIG. 3 is an enlarged end view of a sliding gate structure according to the present invention.

A sliding gate structure 30 according to the present invention is provided to accurately control the discharge of material from each opening provided in the hopper car. Preferably, the sliding gate structure 30 of the present invention is designed as a modular system which promotes retrofitting to existing hopper cars. As illustrated in FIG. 3, each opening in the hopper car is surrounded by a frame 36. Each sliding gate structure 30 of the present invention includes a frame 38, side-by-side gates 40 and 42 slidably mounted thereon, operative mechanisms 44 and 46 for moving the gates 40 and 42, and a valve assembly 110 for independently or conjointly operating the gates. The gates 40 and 42 are arranged for sliding movement along a path extending parallel to the rails 16.

Each opening in the hopper car and the sliding gate structure which controls discharge of material therefrom are substantially similar. Therefore, only the sliding gate structure associated with opening 22 defined by slanted chute portion 18 and disposed between a center sill 32 and sidewall 17 (FIG. 3) on housing 12 will be discussed in detail.

Figure 4:
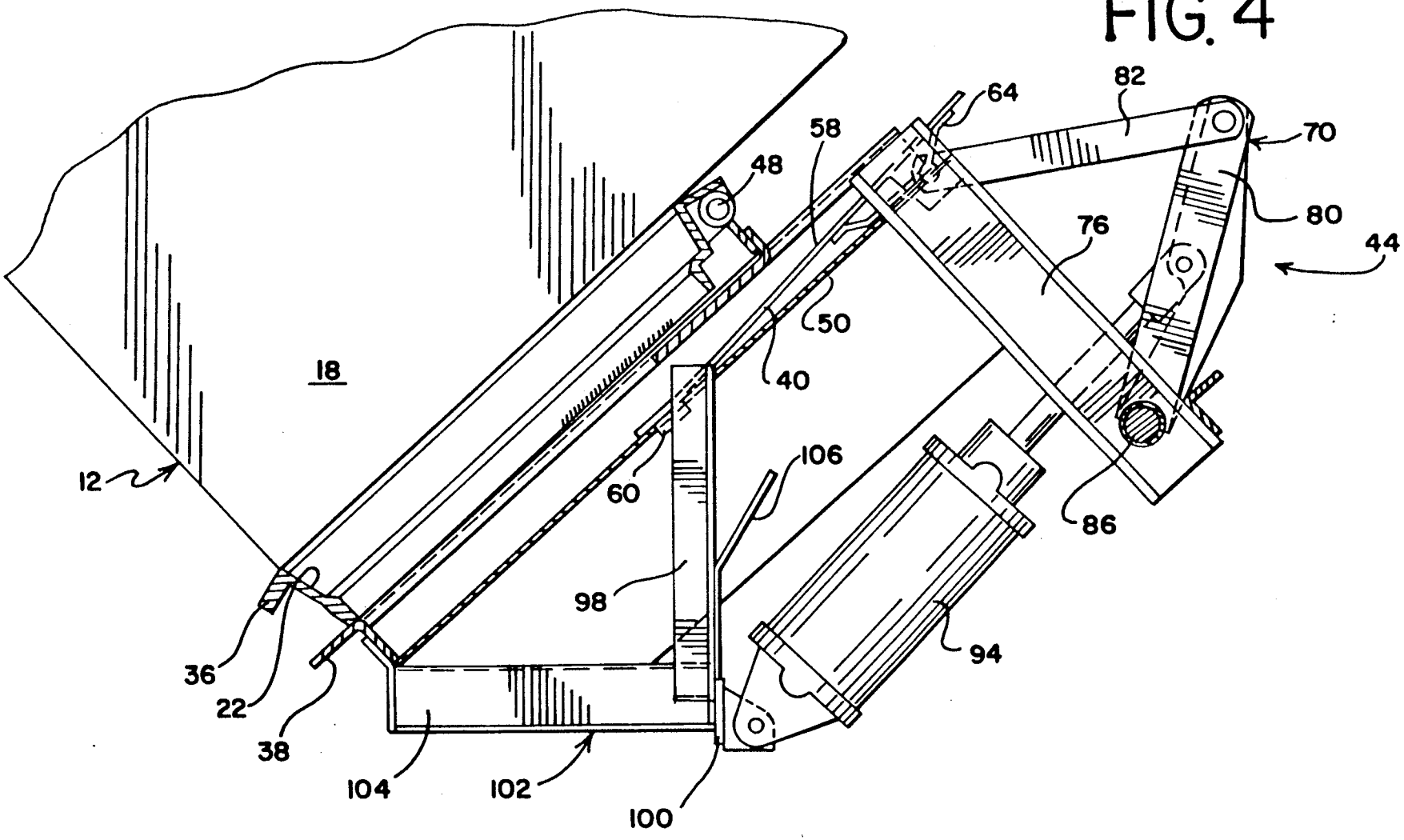
FIG. 4 is a side view of the sliding gate structure taken along line 4—4 of FIG. 3.

Turning now to FIG. 4, the frame 38 of each sliding gate structure is preferably a four sided structure with an open center which is generally aligned with the opening defined by housing 12. The frame 38 of the sliding gate structure is secured on one side to the frame 36 of housing 12 as with hinge pins 48. The edges of the remaining side walls of frame 38 are secured to frame 36 of housing 12 as by welding or riveting.

Figure 5:
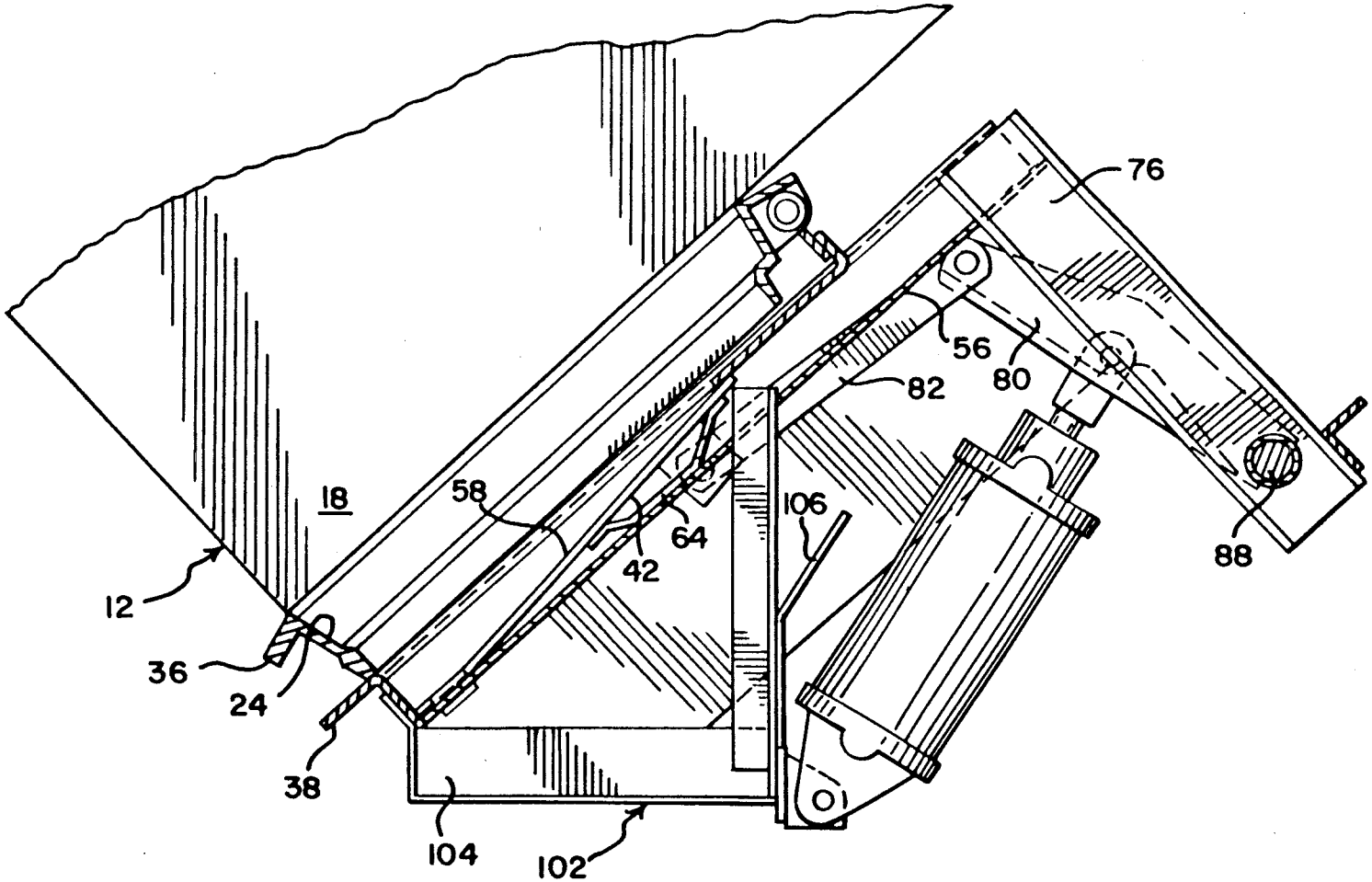
FIG. 5 is a side view of the sliding gate structure taken along line 5—5 of FIG. 3.

As illustrated in FIG. 3, each gate 40 and 42 is arranged for endwise sliding movement on opposite sides of a rail 16 in a manner accurately controlling on which side of the rail 16 the material will be discharged from the hopper car. To promote endwise movement of the sliding gate 40 along a predetermined linear path of travel, each sliding gate structure further includes guide tracks 50 and 52 on opposite lateral sides of the gate 40. Preferably, tracks 50, 52 are suitably secured to the underside of frame 38. Similarly, and to promote endwise movement of sliding gate 42 along a predetermined linear path of travel, each sliding gate structure further includes guide tracks 54 and 56 on opposite lateral sides of the sliding gate 42. Preferably, tracks 54 and 56 are suitably secured to the underside of frame 38. Each guide track 50, 52, 54 and 56 extends rearwardly beyond the frame 38 to provide support to a respective sliding gate when the gate is arranged in an open position as illustrated in FIG. 5.

The sliding gates 40, 42 are substantially similar to one another and, therefore, only sliding gate 40 will be described in detail with the understanding that gate 42 is substantially similar. As illustrated in FIG. 4, each sliding gate defines a generally planar surface 58 which when closed is sufficiently sized to cover that portion of the central opening in frame 38 between the guide tracks arranged on opposite lateral sides of the gate. In a preferred form, the planar surface 58 of each sliding gate is inclined or canted relative to the predetermined path of linear movement of the gate to facilitate opening of the gate.

As illustrated in FIG. 3, depending from opposite lateral sides of the lower end of each gate are a pair of guides 60 and 62; with each guide having a generally L-shaped configuration. A lower leg section of each guide 60, 62 extends generally parallel and in spaced relation of the lower planar surface of the gate. As illustrated, the lower leg section of each guide 60, 62 passes beneath the respective guide track to promote proper linear movement of the gate along its predetermined path of travel.

A self-cleaning action is provided to the guide tracks as the respective slide gate is reciprocated therealong between open and closed positions. To facilitate such a self-cleaning action, the lowermost end of each guide track is beveled as at 68 (FIG. 3) to allow entrapped material to escape from the guide track as a lower end of the gate moves toward its closed position. At its opposite end, each gate is provided with guides 64 and 66 arranged on opposite lateral sides thereof and which are guided along the guide tracks governing linear movement of the gate.

The operating mechanisms 44 and 46 associated with gates 40 and 42, respectively, are independently operable to control discharge of material from the hopper car. Each operating mechanism is substantially identical and hence, the description of operative mechanism 44 will equally apply to other operative mechanisms of each sliding gate structure. Each operative mechanism includes first and second linkage assemblies 70 and 72, respectively, which are substantially similar to each other and are connected to opposite lateral sides of the sliding gate operated thereby.

As illustrated in FIG. 3, a series of braces 74, 76 and 78 depend from the housing 12 in laterally spaced relation to each other. The braces 74, 76 and 78 are laterally joined to each other by a transverse arm 79 which adds rigidity to the braces. As illustrated, braces 74 and 78 depend from opposite lateral sides of each sliding gate structure while brace 76 depends from a mid portion thereof.

Each linkage assembly of each operative mechanism preferably consists of elongated levers 80, 82 and 84 which are designed as a toggle mechanism to provide a variable mechanical advantage facilitating opening and closing of the gate. A first end of each lever 80 of mechanism 44 is connected to a stub shaft 86 which is rotatably mounted between braces 74 and 76. (Note: the first end of each lever 80 forming part of operative mechanism 46 is connected to a stub shaft 88 which is axially aligned with shaft 86 and rotatably mounted between braces 76 and 78.) Levers 82 and 84 are pivotally connected at their first ends to a gate of the sliding gate structure. As illustrated, a pin 90 secures the first ends of levers 82 and 84 to mounting brackets 92 depending from the underside of each gate. The second ends of each of the levers 82 and 84 are pivotally connected to opposite sides of the second end of lever 80.

Each operative mechanism 40, 42 further includes a linearly distendable driver 94 which is connected between the housing 12 and either of the linkage assemblies 70, 72. In a most preferred form, the driver 94 is a fluid operated cylinder. The driver or cylinder 94 is preferably operated pneumatically, but it will be appreciated that it could be operated hydraulically without departing from the spirit and scope of the present invention.

As illustrated in FIG. 3, braces 96 and 98 depend from the underside of housing 12. The lowermost ends of the braces 96 and 98 are joined by a transverse and stationary arm 100. In a preferred embodiment, one end of each driver 94 is pivotally connected to the stationary arm 100 which adds stability and integrity to sliding gate structure. The distendable or operative end of each driver 94 is connected to lever 80 of either linkage assembly 70, 72 of each operative mechanism. As illustrated in FIG. 5, the longitudinal axis of each driver 94 extends substantially perpendicular to the lever 80 when the gate operated thereby is in a closed position. This relationship of the driver 94 to the lever 80 maximizes the pushing force developed by the driver 94 to open the gate.

As illustrated in FIGS. 4 and 5, each sliding gate structure according to the present invention further includes a diverter assembly 102 to facilitate spreading the material as it is discharged from the hopper car to one side or the other of the rail 16. The diverter assembly 102 includes a generally horizontal, inverted V-shaped member 104 which extends beneath and between gates 40, 42 of each slide gate structure. Member 104 is preferably connected at one end to the frame 38 and at its opposite end to the stationary arm 100 between braces 96 and 98. The diverter assembly 102 further includes a transverse shield 106. As illustrated, shield 106 extends upwardly from member 104 between the gates 40, 42 and the driver 94 of each operative mechanism. The shield 106 inhibits material discharged from the hopper from interfering with operation of the drivers 94.

The gates 40, 42 of each sliding gate structure 30 are operated independently of each other to control the discharge of material onto the road bed. As will be appreciated, the discharge of material from the hopper car can be controlled by varying the size of the opening through which material is discharged as a function of the linear position of either slide gate along its predetermined path of travel. As illustrated in FIG. 2, each slide gate structure 30 on the hopper car is controlled by the valve assembly 110 interposed between a source of pressurized fluid 111 and the driver 94 of the operative mechanism of each sliding gate structure.

Each valve assembly 110 preferably includes two control valves 112 and 114 which regulate fluid flow to the drivers 94 of a respective sliding gate structure. Control valve 112 independently control movement of the gate 40 of the respective sliding gate structure with which it is associated while control valve 114 independently controls movement of gate 42 of the respective sliding gate structure with which it is associated. In a most preferred form, each control valve is a three way spring centered valve which is securely mounted to the hopper car proximate to a side wall of the hopper car. Notably, each control valve 112, 114 can be selectively operated such that the gate operated thereby is positionable in either an open, closed or any position therebetween. Without detracting from the spirit and scope of the present invention, the control valves 112, 114 can be operated as tethered units to permit control of the sliding gate structure from an area remote from the openings in the hopper car.

During normal transport, the slide gates 40, 42 of each slide gate structure are in a closed position as illustrated in FIG. 5. In a closed position, the slide gates 40, 42 substantially prevent material from discharging from the hopper car through the openings at the lower end of each chute. In a closed position, the driver 94 of each operative mechanism 40, 42 is retracted so as to protect the operative end of the driver against damage during transportation of the hopper car.

When operated to move the respective gate toward an open position, the driver 94 of each operative mechanism imparts movement to the linkage assemblies 70 and 72 which, in effect, provide a double pulling on the respective slide gate. This double pulling action inhibits skewing of the respective gate relative to the guide tracks during opening and closing movement of the gate.

The design of the linkage assemblies 70, 72 as toggle linkages provides a mechanical advantage during opening and closing of the slide gates. As will be appreciated, the toggle design provides essential breakaway force for initiating movement of the gate from a closed position. As the gate moves toward an open position, the mechanical advantage decreases. Moreover, the design of the linkage assembly as a toggle linkage allows a more compact system in that the stroke of the cylinder is approximately at a 2:1 ratio compared to the travel of the gate. The inclination of the planar surface relative to the guide tracks also facilitates opening of the sliding gate.

As will be appreciated, the linkage assemblies 70, 72 being designed as a toggle mechanism also provides a mechanical advantage during closing action of the doors. The mechanical advantage obtained during the closing action of the door is of importance in forcing the gate to the final closed position and thereby facilitating the displacement of any residue material which may be retained within the opening. Moreover, the beveled configuration 68 at a lower end of track of each guide facilitates a self-cleaning action as the gate is moved into a closed position.

Using a fluid operated linearly distendable driver in contrast to an elongated manually operated lever for moving each of the gates of the sliding gate structure has numerous benefits. The use of a powered driver advantageously lessens the physical effort required to operate the gate structure. Moreover, the use of a powered driver substantially removes restrictions or limitations normally associated with the degree of physical effort required to open and close the gates. Accordingly, gate sizes can be increased.

The provision of a control system for operating the sliding gate structure offers still further benefits. Arranging the control system proximate to the side of the car provides ease of accessibility to the valve structures 110 comprising the control system to facilitate operation of the gates. Moreover, a control system for operating the sliding gate structure allows careful control of the size of the gate openings and thereby promotes operating performance during road bed maintenance operations.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover by the appended claims all such modifications as fall within the scope of the claims.

What is claimed is:

1. A sliding gate structure for a railroad hopper car, said hopper car having a housing with sidewalls and an opening defined by said housing between said sidewalls and through which material is discharged from said car, said opening being provided at a lower end of a slanted chute defined by said housing, said sliding gate structure comprising:

first and second sliding gates arranged side-by-side beneath said opening to regulate the discharge of material therethrough, each gate being mounted for movement along a predetermined linear path within guide tracks connected to said housing;

each of said gates defines a generally planar surface which is moved relative to said opening, said planar surface being inclined relative to said predetermined path of movement to reduce the effort required to open said gate; and operative means for independently moving each sliding gate between closed and open positions, said operative means including a pair of linkage assemblies connected to each sliding gate, each linkage assembly being connected at a first end to opposite sides of one of said sliding gates and at a second end to said housing to inhibit the gate from skewing relative to said guide tracks during its movement, wherein each linkage assembly includes a first lever connected at a first end to said gate and a second end, and a second lever with a first end connected to said housing and a second end, and wherein the second end of each levers is rotatably joined to each other; a fluid operating cylinder operable in combination with each pair of said linkage assemblies for slidably moving the respective gates between closed and open positions, said cylinder being secured to said housing and to said second lever of only one of said linkage assemblies whereby about a 2:1 ratio between gate movement and cylinder distention is achieved when said gate is moved into either an open position or a closed position, and said cylinder provides an opening push force which is directed substantially perpendicular to said second lever; and control means arranged proximate a side of the hopper car for regulating fluid flow from a source of pressurized fluid to said cylinder to control movement of said gates.

* * * * *